US008596473B2

(12) United States Patent
Newbould et al.

(10) Patent No.: US 8,596,473 B2
(45) Date of Patent: Dec. 3, 2013

(54) HORIZONTALLY MOUNTED SHELF ASSEMBLY AND ACCESSORIES THEREFOR

(75) Inventors: Peter J. Newbould, Milan (IT); Ivana Babic, Milan (IT); Craig Thompson, Inver Grove Heights, MN (US); James L. Bries, Cottage Grove, MN (US); Russell G. Pihlstrom, Blaine, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 492 days.

(21) Appl. No.: 11/849,402

(22) Filed: Sep. 4, 2007

(65) Prior Publication Data

US 2008/0053931 A1 Mar. 6, 2008

Related U.S. Application Data

(60) Provisional application No. 60/842,622, filed on Sep. 6, 2006.

(51) Int. Cl.
*A47F 5/08* (2006.01)

(52) U.S. Cl.
USPC ..... 211/88.01

(58) Field of Classification Search
USPC ..... 211/88.01, 119, 90.03, 119.009, 211/119.011, 106.01, 70.6, 85.29, 66, 211/85.12, 87.01, 90.01, 119.003, 134, 211/60.1, 63, 64, 65, 68, 69.9, 70.2, 70.5, 211/70.7, 70.8, 123; 248/205.3, 214, 215, 248/220.21, 225.21, 235, 244, 245, 250, 248/683; D6/567, 569, 571, 572
See application file for complete search history.

(56) References Cited

U.S. PATENT DOCUMENTS

| | | | | | |
|---|---|---|---|---|---|
| 890,693 | A | * | 6/1908 | McCoy | 248/213.2 |
| 1,353,898 | A | * | 9/1920 | Decker et al. | 248/310 |
| 1,457,166 | A | * | 5/1923 | Hayes | 211/88.04 |
| 1,571,000 | A | * | 1/1926 | Eustis et al. | 211/65 |
| 1,575,270 | A | * | 3/1926 | Jankowsky | 211/87.01 |
| 1,692,059 | A | * | 11/1928 | Starner | 211/123 |
| 1,846,129 | A | * | 2/1932 | Gibbs | 126/505 |
| 1,995,246 | A | * | 3/1935 | Greims | 211/94.01 |
| D119,207 | S | * | 2/1940 | Sterne | D27/180 |
| D119,760 | S | * | 4/1940 | Kopp | D6/572 |
| 2,403,834 | A | * | 7/1946 | Streit | 223/87 |
| 2,503,375 | A | * | 4/1950 | Burg | 211/104 |
| 2,546,720 | A | * | 3/1951 | Brothers | 211/85.3 |
| D165,553 | S | * | 12/1951 | Schoor | D6/572 |
| 2,577,860 | A | * | 12/1951 | Schoor | 211/105.1 |
| 2,643,775 | A | * | 6/1953 | Franklin | 211/85.3 |
| 2,659,722 | A | | 11/1953 | Tobiassen | |
| D171,468 | S | * | 2/1954 | Simon | D6/528 |
| 2,707,052 | A | * | 4/1955 | Brown | 211/65 |

(Continued)

FOREIGN PATENT DOCUMENTS

| | | |
|---|---|---|
| CN | 2126998 Y | 2/1999 |
| DE | 33 31 016 C2 | 7/1992 |

(Continued)

*Primary Examiner* — Joshua Rodden
(74) *Attorney, Agent, or Firm* — David B. Patchett

(57) ABSTRACT

A horizontally mounted shelf assembly includes an elongated support rail, at least one accessory slidaby connected with the support rail, and at least one stretch releasing adhesive strip arranged between the support rail and a wall for securing the shelf assembly to the wall. Each accessory may also be separately mounted on the wall using stretch releasing adhesive strips.

15 Claims, 2 Drawing Sheets

(56) References Cited

U.S. PATENT DOCUMENTS

| | | | | | |
|---|---|---|---|---|---|
| 2,746,828 | A | * | 5/1956 | Amore | 312/405.1 |
| 2,806,609 | A | * | 9/1957 | Grobizna | 211/90.01 |
| 2,815,863 | A | * | 12/1957 | Larson | 211/70.1 |
| 2,931,514 | A | * | 4/1960 | Hughes | 211/41.4 |
| 2,979,211 | A | * | 4/1961 | Fritzel | 211/119.009 |
| 3,172,540 | A | * | 3/1965 | Berge | 211/106.01 |
| 3,435,955 | A | * | 4/1969 | Brunette | 211/24 |
| 3,659,722 | A | * | 5/1972 | Carroll | 211/106 |
| 4,024,312 | A | | 5/1977 | Korpman | |
| 4,060,214 | A | * | 11/1977 | Metcalf | 248/165 |
| 4,108,314 | A | | 8/1978 | Racca | |
| 4,201,304 | A | * | 5/1980 | Wicklund | 211/88.04 |
| 4,318,486 | A | * | 3/1982 | Bobrowski | 211/87.01 |
| 4,367,819 | A | * | 1/1983 | Lewis | 211/59.1 |
| 4,467,925 | A | * | 8/1984 | Ratzloff et al. | 211/70.6 |
| 4,501,369 | A | * | 2/1985 | Fox | 211/133.1 |
| 4,869,378 | A | * | 9/1989 | Miller | 211/94.01 |
| 4,899,971 | A | * | 2/1990 | Elkin | 248/225.11 |
| 4,969,580 | A | | 11/1990 | Mikhail | |
| 5,069,350 | A | * | 12/1991 | Wolff et al. | 211/106.01 |
| 5,137,158 | A | * | 8/1992 | Brockway | 211/106.01 |
| 5,255,401 | A | | 10/1993 | Sambrookes et al. | |
| 5,289,927 | A | | 3/1994 | Emery | |
| 5,332,107 | A | | 7/1994 | Williams | |
| 5,516,581 | A | | 5/1996 | Kreckel et al. | |
| 5,588,543 | A | * | 12/1996 | Finger | 211/90.01 |
| 5,687,856 | A | * | 11/1997 | Kendrena | 211/70.6 |
| 5,740,927 | A | * | 4/1998 | Yemini | 211/70.6 |
| D411,066 | S | * | 6/1999 | Romeo | D6/567 |
| D411,701 | S | * | 6/1999 | Klein et al. | D6/513 |
| D412,804 | S | * | 8/1999 | Romeo | D6/567 |
| D413,471 | S | * | 9/1999 | Romeo | D6/567 |
| 6,021,906 | A | * | 2/2000 | Heien | 211/41.3 |
| 6,231,962 | B1 | | 5/2001 | Bries et al. | |
| 6,273,279 | B1 | * | 8/2001 | Wolf | 211/86.01 |
| 6,349,507 | B1 | * | 2/2002 | Muellerleile | 52/36.5 |
| 6,406,781 | B1 | * | 6/2002 | Hamerski | 428/317.3 |
| 6,499,707 | B2 | | 12/2002 | Hamerski et al. | |
| 6,520,351 | B1 | | 2/2003 | Zadro | |
| 6,541,089 | B1 | | 4/2003 | Hamerski et al. | |
| D474,933 | S | * | 5/2003 | Kaposi | D6/569 |
| 6,569,521 | B1 | | 5/2003 | Sheridan et al. | |
| 6,641,910 | B1 | | 11/2003 | Bries et al. | |
| 6,811,126 | B2 | * | 11/2004 | Johansson et al. | 248/205.3 |
| 6,972,141 | B1 | | 12/2005 | Bries et al. | |
| 6,991,133 | B2 | | 1/2006 | Rutherford et al. | |
| 7,078,093 | B2 | | 7/2006 | Sheridan et al. | |
| 7,178,770 | B2 | | 2/2007 | Ryu | |
| 7,188,738 | B2 | * | 3/2007 | Stafford et al. | 211/72 |
| 7,322,482 | B2 | * | 1/2008 | Caradonna | 211/74 |
| 7,322,551 | B2 | * | 1/2008 | Simonsen | 248/231.81 |
| D580,745 | S | * | 11/2008 | Shaha et al. | D8/367 |
| D589,278 | S | * | 3/2009 | Shaha et al. | D6/458 |
| D589,728 | S | * | 4/2009 | Shaha et al. | D6/510 |
| 7,530,329 | B1 | * | 5/2009 | Paris et al. | 119/61.57 |
| 7,540,456 | B2 | * | 6/2009 | Thompson | 248/205.3 |
| 7,578,399 | B1 | * | 8/2009 | Mulaw | 211/10 |
| D604,979 | S | * | 12/2009 | Shaha et al. | D6/553 |
| 7,971,737 | B2 | * | 7/2011 | Newbould et al. | 211/90.01 |
| 2003/0049439 | A1 | * | 3/2003 | Johansson et al. | 428/343 |
| 2003/0070998 | A1 | * | 4/2003 | Bulka | 211/66 |
| 2003/0192842 | A1 | * | 10/2003 | Suttles | 211/87.01 |
| 2004/0086710 | A1 | * | 5/2004 | Pitzen et al. | 428/343 |
| 2004/0099617 | A1 | * | 5/2004 | Elias et al. | 211/41.3 |
| 2004/0255499 | A1 | | 12/2004 | Kirschhoffer et al. | |
| 2005/0236347 | A1 | * | 10/2005 | Cole et al. | 211/94.01 |
| 2005/0247653 | A1 | * | 11/2005 | Brooks | 211/94.01 |
| 2006/0124811 | A1 | | 6/2006 | Tatarsky et al. | |
| 2006/0180561 | A1 | * | 8/2006 | Wisnoski et al. | 211/94.01 |
| 2006/0289372 | A1 | * | 12/2006 | Yang et al. | 211/41.3 |
| 2007/0012636 | A1 | * | 1/2007 | Wisnoski et al. | 211/70.6 |
| 2007/0017886 | A1 | * | 1/2007 | Kao | 211/94.01 |
| 2007/0102601 | A1 | * | 5/2007 | Thompson | 248/205.1 |
| 2007/0125723 | A1 | * | 6/2007 | Rockel | 211/16 |
| 2007/0175843 | A1 | * | 8/2007 | Kanasashi et al. | 211/94.01 |
| 2008/0053931 | A1 | * | 3/2008 | Newbould et al. | 211/88.01 |
| 2008/0053932 | A1 | * | 3/2008 | Newbould et al. | 211/88.01 |
| 2008/0053934 | A1 | * | 3/2008 | Newbould et al. | 211/90.01 |
| 2008/0087616 | A1 | * | 4/2008 | Weston | 211/16 |
| 2008/0105637 | A1 | * | 5/2008 | Lawson | 211/94.01 |
| 2008/0185353 | A1 | * | 8/2008 | Immerman et al. | 211/16 |
| 2008/0296244 | A1 | * | 12/2008 | Tomassetti | 211/119.009 |
| 2008/0302744 | A1 | * | 12/2008 | Rosenberg | 211/94.01 |
| 2009/0014401 | A1 | * | 1/2009 | Tallman | 211/106.01 |
| 2010/0065523 | A1 | * | 3/2010 | Northrup et al. | 211/90.02 |
| 2010/0133218 | A1 | * | 6/2010 | Yang et al. | 211/119.009 |

FOREIGN PATENT DOCUMENTS

| | | |
|---|---|---|
| JP | 45021628 | 8/1970 |
| JP | 4101678 | 9/1992 |
| JP | 6-29483 | 4/1994 |
| JP | 6-29486 U | 4/1994 |
| JP | 6-217893 | 8/1994 |
| JP | 2002-482 | 1/2002 |
| WO | WO 03/009732 A1 | 2/2003 |

* cited by examiner

HORIZONTALLY MOUNTED SHELF ASSEMBLY AND ACCESSORIES THEREFOR

CROSS REFERENCE TO RELATED APPLICATION

This application claims the benefit of U.S. Provisional Patent Application No. 60/842,622, filed Sep. 6, 2006, the disclosure of which is incorporated by reference herein in its entirety.

TECHNICAL FIELD

The present invention relates generally to wall mountable storage and organizing articles and, more particularly, to a shelf assembly that can be adhesively mounted to, for example, a vertical wall surface in a bathroom or the interior surface of a bath or shower enclosure to hold a variety of items commonly used in the bathroom or shower.

BACKGROUND

Shower and bath storage devices, often referred to as shower or bath caddies, are commonly used to hold and/or store items such as soap, shampoo, and other bath items in shower and bath enclosures. Because of the weight of the stored items and because it is generally not practical to mount such items in shower or bath enclosures using mechanical fasteners, such as nails and screws, such devices are typically hung from the shower nozzle fixture. Such devices are known in the prior art. U.S. Pat. No. 4,969,580 (Mikhail Essatt), U.S. Pat. No. 4,108,314 (Racca), U.S. Pat. No. 5,255,401 (Sambrookes et al.), and U.S. Pat. No. 6,520,351 (Zadro), for example, disclose such devices. It is also known to mount such devices using suction cups as disclosed in, for example, U.S. Pat. No. 5,289,927 (Emery).

Such devices, however, suffer from certain drawbacks and shortcomings. Devices that hang from the shower nozzle fixture, for example, tend to be large and cumbersome and because such devices must hang down from the shower nozzle fixture below the shower head so the items in the caddy can be accessed by a user, they are unstable and tend to swing sideways or slide off of the shower nozzle fixture. In addition, the mounting location is limited by the location of the shower nozzle fixture such that they cannot be moved, and, because they must be mounted immediately below the shower head, they tend to interfere with the use of the shower. Devices mounted with suction cups, on the other hand, have limited holding capacity and tend to lose their holding ability over time. As a result, devices mounted with suction cups frequently fail, thereby causing the device and its contents to fall off the wall. The need therefore exists for a storage device that can be adhesively mounted to the wall surface of a shower or bath enclosure that is inexpensive, easy to install, is adjustable, and holds strongly enough to support items commonly stored in such devices.

The need therefore exists for a storage device that can be adhesively mounted to the wall surface of a shower or bath enclosure that is inexpensive, easy to make and use, is adjustable and versatile, and holds strongly enough to support items commonly stored in such devices.

SUMMARY

The invention overcomes the above-identified limitations in the field by providing an adjustable shelving system that can be adhesively mounted to, for example, the wall surface of a shower or bath enclosure, that is versatile, inexpensive, easy to install, and holds strongly enough to support items commonly stored in such devices.

In one embodiment, the present invention provides a horizontally mounted shelf assembly including an elongated support rail, at least one accessory removably connected with the support rail, and at least one stretch releasing adhesive strip arranged between the support rail and the wall for securing the shelf assembly to the wall. The elongated support rail includes a body portion and a pair of leg portions extending at an angle from the ends of the body portion, thereby to space the body portion from the wall when the shelf assembly is mounted on the wall. In one embodiment, the elongated support rail includes back plate portions at the ends of the leg portions, the back plate portions having generally planar surfaces opposite the leg portions. The at least one stretch releasing adhesive strip is arranged on the back plate planar surfaces. In another aspect of the invention, each accessory includes a front retaining wall portion, a shoulder portion, and a rear retaining wall portion arranged to define an elongated mounting channel that allows for sliding engagement of the accessory on the support rail.

In another aspect, the present invention provides an accessory that can be adhesively mounted directly on a wall surface using a stretch releasing adhesive strip having a non-adhesive pull tab, the accessory including a front retaining wall portion, a shoulder portion, and a rear retaining wall portion arranged to define an elongated channel between the front retaining wall portion and the rear retaining wall portion.

BRIEF DESCRIPTION OF DRAWINGS

The present invention will be further described with reference to the accompanying drawings, in which.

DETAILED DESCRIPTION

Figure 1:
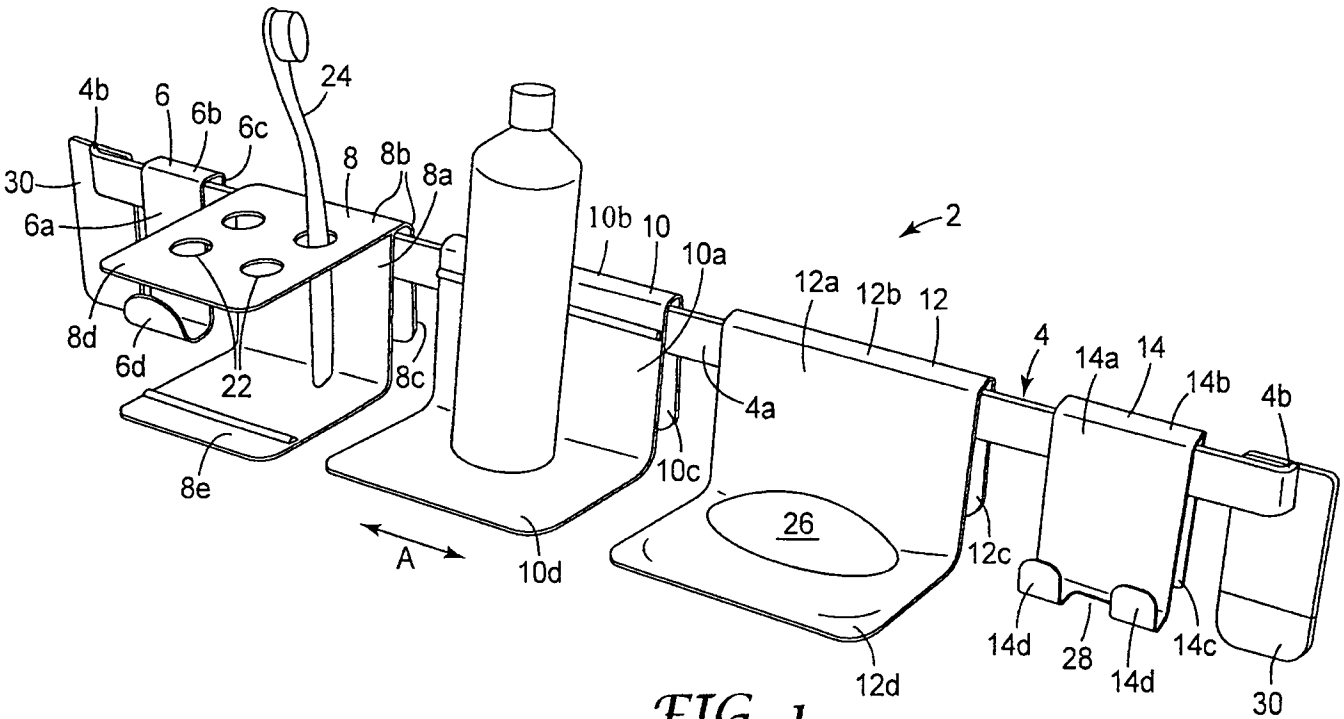
FIG. 1 is a perspective view of a horizontally wall mounted shelf assembly according to the invention.
Figure 2:
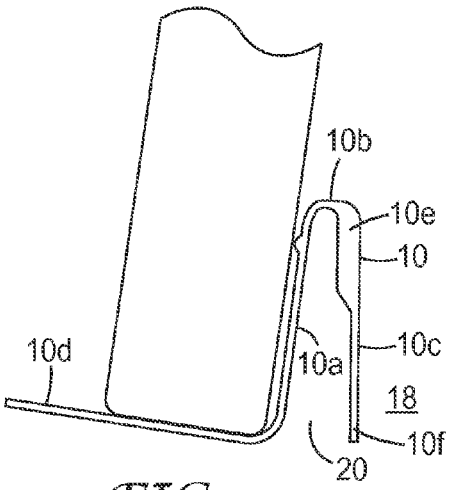
FIG. 2 is side plan view of an accessory for mounting on the shelf assembly.
Figure 3:
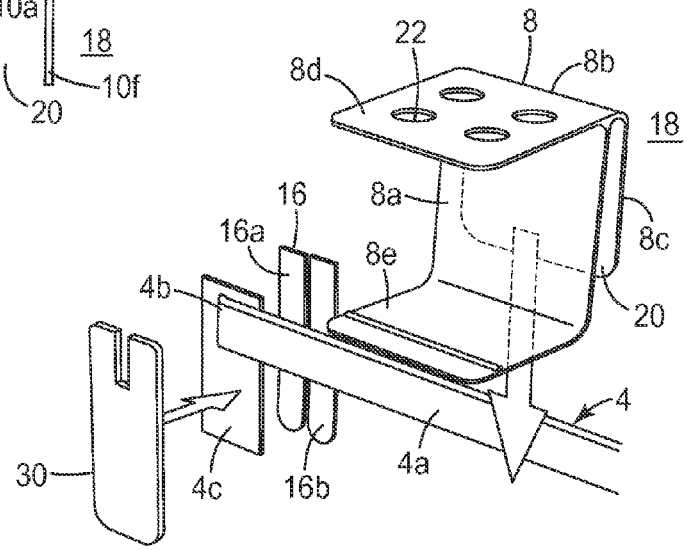
FIG. 3 is an exploded detailed view of one end of the shelf assembly.

Referring now to the drawings, wherein like reference numerals refer to like or corresponding parts throughout the several views, FIGS. 1-3, show a horizontally wall mounted shelf assembly 2 for holding items such as soap, shampoo and the like in, for example, a shower or bath enclosure. The shelf assembly 2 includes an elongated support rail 4, a plurality of accessories 6, 8, 10, 12, 14 slidaby connected with the support rail 4, and a pair of stretch releasing adhesive strips 16 affixed to the rear surface of the support rail 4, thereby to adhesively bond the support rail 4 to a wall surface 18.

The support rail 4 includes a generally linear body portion 4*a* and a pair of leg portions 4*b* that extend generally rearwardly from the body portion 4*a* toward the wall surface 18. In this manner, the leg portions 4*b* serve to space the body portion 4*a* from the wall surface 18 when the assembly 2 is mounted on the wall surface 18, and thereby allow the accessories 6, 8, 10, 12, 14 to be mounted on the support rail 4. In the illustrated embodiment, the support rail 4 includes back plate portions 4*c* (FIG. 3) at the terminal ends of the leg portions 4*b*. Each back plate portion 4*c* includes generally planar surfaces opposite the leg portion 4*b* to which the stretch releasing adhesive strips 16 are adhered, thereby serving to adhesively bond the support rail 4 to the wall surface 18.

In one embodiment, the back plate portions 4*c* are formed as separate feet which are pivotally connected with the leg portions 4*b*. Connecting the back plate "feet" to the legs in this manner allows the feet to move independently relative to the legs, and thereby allows the feet to have increased surface contact with a curved surface, such as the curved surfaces commonly found on fiberglass shower and bath enclosures.

Each accessory 6, 8, 10, 12, 14 includes a front retaining wall portion 6*a*, 8*a*, 10*a*, 12*a*, 14*a*, a shoulder portion 6*b*, 8*b*, 10*b*, 12*b*, 14*b*, and a rear retaining wall portion 6*c*, 8*c*, 10*c*, 12*c*, 14*c*, which combine to define an elongated mounting channel 20 and allow the accessories to be slidably mounted on the support rail 4. That is, the sliding connection between the support rail 4 and the mounting channel 20 allows the position of each accessory 6, 8, 10, 12, 14 to be laterally adjusted along the length of the support rail 4 as indicated by arrow A.

As shown most clearly in FIG. 2, the distance between the front retaining wall portion 10*a* and the rear retaining wall portion 10*c* increases in the direction away from the shoulder portion 10*b*, such that channel 20 is tapered in the direction of the shoulder portion 10*b*. The front retaining wall portion 10*a* having a bottom portion opposite the shoulder portion 10*b* and the rear retaining wall portion 10*c* terminating at a free end opposite the shoulder portion 10*b*, such that when the support rail 4 is received in the channel 20, the bottom portion and the free end are below the body portion 4*a* of the support rail 4. Furthermore, the rear retaining wall portion 10*c* comprises abuse section 10*e* adjacent to the shoulder portion 10*b* and a tail section 10*f* extending from the base section 10*e* in a direction opposite to the shoulder portion 10*b*, the base section 10*e* and the tail section 10*f* having a combined planar outer surface, and the base section 10*e* having a material thickness greater than the tail section 10*f*. When formed in this manner, each accessory 6, 8, 10, 12, 14 will tend to slope downwardly in the direction toward the wall surface 18, thereby causing items arranged on the accessory to tip backward toward the wall surface 18.

Alternatively, the rear retaining wall portion 10*c* may be formed in the shape of a "closed hook," such that the end of the rear retaining wall portion 10*c* is arranged adjacent to the front retaining wall portion 10*a*. Formed in this manner, the rear retaining wall portion 10*c* and front retaining wall portion 10*a* are manually separated to connect or remove the accessory 10 from the support rail, and in so doing, a small force is created to more securely connect the accessory 10 to the support rail 4. In addition, the rear retaining wall portion 10*c* may include a detent (not shown), such that the rear retaining wall portion 10*c* snaps into place on the support rail 4, thereby providing a more secure attachment between the accessory 10 and the support rail 4.

In the illustrated embodiment, accessory 6 is a unitary hook including a curved hook portion 6*d* extending outwardly and upwardly from the lower end of the front retaining wall portion 6*a*. Accessory 8 is a unitary toothbrush holder including spaced top 8*d* and bottom 8*e* shelf portions extending outwardly from the front retaining wall portion 8*a*. The top shelf portion 8*d* contains openings 22 for receiving the handle of a toothbrush 24.

Accessory 10 is a unitary shelf structure configured to hold, for example, a bottle of shampoo or hair conditioner. The shelf structure 10 includes a bottom wall portion 10*d* extending outwardly from the front retaining wall portion 10*a*. Accessory 12 is a unitary tray including a dish portion 12*d* extending outwardly from the front retaining wall portion 12*a* configured to hold a bar of soap 26. And accessory 14 is a unitary hook including a pair of spaced raised regions 14*d* defining a recessed region 28 there between configured to hold a conventional razor. Other accessories, such as a mirror or caddies designed for specific purposes, may also be provided.

As shown in FIG. 3, stretch releasing adhesive strips 16 are arranged between the back plate portions 4*c* of the support rail 4 and the wall surface 18, and thereby adhesively bond the shelf assembly 2 to the wall surface 18. A suitable stretch releasing adhesive is the double-sided stretch releasable adhesive strips available from 3M Company, St. Paul, Minn. under the COMMAND® trade designation. Commercially available COMMAND® adhesive strips are currently manufactured as discrete strips with one end of the strip including a non-adhesive pull tab to facilitate stretching of the strip during removal.

Stretch releasing adhesives are high performance pressure-sensitive adhesives that combine strong holding power with clean removal and no surface damage. The double-sided adhesive strips 16 may be any conventionally known stretch releasing adhesive tape including a stretch releasing adhesive tape with an elastic backing, a stretch releasing adhesive tape with a highly extensible and substantially inelastic backing, or a stretch releasing adhesive tape comprising a solid elastic pressure sensitive adhesive, but are preferably stretch releasable adhesive strips that are moisture resistant (i.e. they maintain their holding power in the presence of water and/or in high humidity environments).

Specific tapes suitable for use in the various embodiments of the present invention include the pressure sensitive adhesive tapes with elastic backings described in U.S. Pat. No. 4,024,312 (Korpman), the pressure sensitive adhesive tapes with highly extensible and substantially inelastic backings described in U.S. Pat. Nos. 5,516,581 (Kreckel et al.) and 6,231,962 (Bries et al.), 6,569,521 (Sheridan et al.), 7,078,093 (Sheridan et al.), and the solid elastic pressure sensitive adhesive described in German Patent No. 33 31 016. Other suitable stretch releasing adhesive constructions include the stretch removable adhesive tape laminate including a separable fastener described in U.S. Pat. No. 6,972,141 (Bries et al.), and the elongate stretch removable tape constructions described in U.S. Pat. Nos. 6,641,910 (Bries et al.), and 6,541,089 (Hamerski et al.).

The stretch releasing adhesive strips 16 include an adhesive portion 16*a*, which is typically concealed by the support rail 4 when the support rail 4 is mounted to the wall surface 18, and a non-adhesive pull tab portion 16*b* that extends outwardly beyond the bottom of the back plate portion 4*c* as shown in FIG. 3. In the illustrated embodiment, the shelf assembly 2 further includes an optional cover plate 30 arranged over the back plate portion 4*c* of the support rail 4. When the cover plate 30 is connected with the support rail 4, it serves to conceal the non-adhesive pull tab portions 16*b* of the stretch releasing adhesive strips 16, but, when removed from the support rail 4, the non-adhesive pull tabs 16*b* are visible and may be readily accessed by a user wishing to stretch remove the adhesive strips 16 from the wall surface 18.

If the adhesive strips 16 include a separable fastener, such as is described in U.S. Pat. No. 6,972,141 (Bries et al.), the back plate portions 4*c* can be designed to conceal both the adhesive portion 16*a* and the non-adhesive pull tab portion 16*b* of the adhesive strips. This is because each adhesive strip can be removed by first separating the adhesive strip via the separable fastener and then stretch removing each remaining half from its respective surface.

Figure 4:
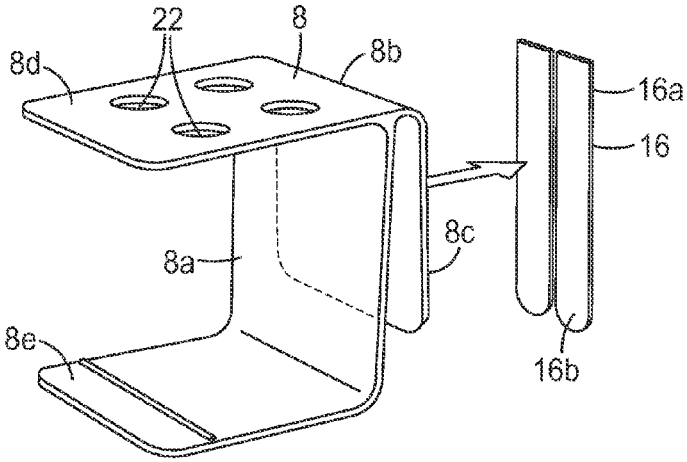
FIG. 4 is an exploded perspective view of an accessory that can be mounted directly on a wall surface.

In accordance with another aspect of the invention, each of the accessories 6, 8, 10, 12, 14 may also be separately and individually mounted directly to the wall surface 18 using stretch releasing adhesive strips 16. This is illustrated in FIG. 4 with respect to accessory 8, the unitary toothbrush holder, but is applicable to each accessory 6, 8, 10, 12, 14. In this aspect of the invention, stretch releasing adhesive strips 16 are bonded to the rear retaining wall portion 8*c* on the surface opposite the front retaining wall portion 8*a* with the non-adhesive pull tab portions 16*b* extending downwardly beyond the bottom end of the rear retaining wall portion 8*c*, such that the non-adhesive pull tab portions 16*b* are accessible to a user wishing to stretch remove the adhesive strips 16 from the wall surface 18.

To allow the non-adhesive pull tab portions 16*b* of the adhesive strips 16 to be concealed by the accessory 8 when the accessory 8 is mounted on the wall surface 18, the front retaining wall portion 8*a* may be made longer than the rear retaining wall portion 8*c*. In this manner, the front retaining wall portion 8*a* extends in overlapping relation with the rear retaining wall portion 8*c* and also extends in overlapping relation with the non-adhesive pull tab portion 16*b* of the adhesive strip 16. Thus, the design of the accessories 6, 8, 10, 12, 14 provides a unitary structure that conceals the non-adhesive pull tab portion 16*b* of the adhesive strips 16 when the accessories are mounted on the wall surface 18, but also provides a design whereby the non-adhesive pull tabs can be readily accessed by a user wishing to stretch remove the adhesive strip(s) 16 from the wall surface 18. That is, because the front retaining wall portion 8*a* overlays the non-adhesive pull tab 16*b*, the pull tab 16*b* is generally concealed from view when the accessory 8 is viewed directly from the front, but because the front retaining wall portion 8*a* is spaced from the rear retaining wall portion 8*c*, a user can readily access the pull tab 16*b* by reaching behind the front retaining wall portion 8*a*.

The shelf assembly 2, including both the support rail 4 and the accessories, 6, 8, 10, 12, 14 may formed of any suitable material including, metals and synthetic plastic materials. In one embodiment, the support rail 4 and the accessories, 6, 8, 10, 12, 14 are formed from an injected molded synthetic plastic material.

Persons of ordinary skill in the art may appreciate that various changes and modifications may be made to the invention described above without deviating from the inventive concept. For example, it will be recognized that although the shelf assembly 2 is illustrated as being mounted with two adhesive strips, one or more such strips may be used. Thus, the scope of the present invention should not be limited to the structures described in this application, but only by the structures described by the language of the claims and the equivalents of those structures.

What is claimed is:

1. A horizontally wall mountable shelf assembly, comprising:

(a) an elongated support rail including a body portion and a first back plate portion, the body portion defining opposing ends and extending between the opposing ends to define a length direction of the support rail, the support rail further defining a width direction transverse to the length direction, wherein the first back plate portion is connected to one of the opposing ends, and further wherein a size of the back plate portion in the width direction is greater than a size of the body portion in the width direction;

(b) at least one accessory transversely movably connected with the body portion, each accessory including a front retaining wall portion, a shoulder portion, and a rear retaining wall portion arranged to define an elongated mounting channel for mounting sliding engagement with the body portion, the front retaining wall portion having a bottom portion opposite the shoulder portion and the rear retaining wall portion terminating at a free end opposite the shoulder portion, wherein a distance between the front retaining wall portion and the rear retaining wall portion increases in a direction away from the shoulder portion to define an enlarged opening to the channel between the bottom portion and the free end such that the accessory is configured for mounting to the body portion by sliding the body portion into the channel via the opening, and further wherein upon assembly of the accessory over the body portion:

the front retaining wall portion extends adjacent a front surface of the body portion and the rear retaining wall portion extends adjacent a back surface of the body portion, a size of the rear retaining wall portion in the width direction and a size of the front retaining wall portion in the width direction are greater than the size of the body portion in the width direction such that upon assembly, the body portion abuts the shoulder portion and the bottom portion and the free end are below the body portion; and (c) at least one stretch releasing adhesive strip arranged between the first back plate portion and a wall for securing the shelf assembly to the wall.

2. A shelf assembly as defined in claim 1, wherein the elongated support rail further includes a pair of leg portions extending at an angle from the opposing ends, respectively, of the body portion, thereby to space the body portion from the wall when the shelf assembly is mounted on the wall.

3. A shelf assembly as defined in claim 2, wherein the first back plate portion is at an end of a first one of the leg portions, wherein the elongated support rail includes a second back plate portion at an end of a second one of the leg portions, the back plate portions having generally planar surfaces opposite the leg portions and further wherein the at least one stretch releasing adhesive is arranged on the back plate planar surfaces.

4. A shelf assembly as defined in claim 1, wherein the free end of the rear retaining wall portion is arranged adjacent the front retaining wall portion, and the front and rear retaining wall portions form a snap fit with the support rail.

5. A shelf assembly as defined in claim 1, wherein the accessory is a unitary hook including the bottom portion extending outwardly from the front retaining wall portion.

6. A shelf assembly as defined in claim 1, wherein the accessory is a unitary shelf structure configured to hold a single container of liquid, the shelf structure including the bottom portion extending outwardly from the front retaining wall portion.

7. A shelf assembly as defined in claim 1, wherein the accessory is a unitary tray including a support portion extending outwardly from the front retaining wall portion which is configured to hold a bar of soap.

8. A shelf assembly as defined in claim 1, wherein the accessory is a unitary hook including a pair of spaced raised regions defining a recessed region there between which is configured to hold a conventional razor.

9. A shelf assembly as defined in claim 1, wherein the accessory is a unitary toothbrush holder including spaced top and bottom shelf portions extending outwardly from the front retaining wall portion, the top shelf portion containing at least one opening for receiving the handle of a toothbrush.

10. A shelf assembly as defined in claim 1, wherein the stretch releasing adhesive strip is a double-sided adhesive strip including a non-adhesive pull tab at one end, and wherein when the support rail is mounted horizontally on a vertical wall surface, the non-adhesive pull tab extends outwardly beyond an end of the first back plate portion, whereby the non-adhesive pull tab is accessible to a user wishing to stretch remove the adhesive strip from the wall surface.

11. A shelf assembly as defined in claim 10, further comprising a cover plate removably connected with the first back plate portion, whereby when the cover plate is connected with the first back plate portion, the cover plate serves to conceal the non-adhesive pull tab of the stretch releasing adhesive strip.

12. A shelf assembly as defined in claim 1, wherein the support rail and accessory are formed of an injected molded synthetic plastic material.

13. A horizontally wall mountable shelf assembly comprising:

(a) an elongated support rail including a body portion and a back plate portion at an end of the body portion;

(b) at least one accessory transversely movably connected with the body portion, each accessory including a front retaining wall portion, a shoulder portion, and a rear retaining wall portion arranged to define an elongated mounting channel for mounting sliding engagement with the body portion, wherein a distance between the front retaining wall portion and the rear retaining wall portion increases in a direction away from the shoulder portion;

(c) at least one stretch releasing adhesive strip arranged between the back plate portion and a wall for securing the shelf assembly to the wall, wherein the stretch releasing adhesive strip is a double-sided adhesive strip including a non-adhesive pull tab at one end, and wherein when the support rail is mounted horizontally on a vertical wall surface, the non-adhesive pull tab extends outwardly beyond an end of the back plate portion, whereby the non-adhesive pull tab is accessible to a user wishing to stretch remove the adhesive strip from the wall surface; and (d) a cover plate removably connected with the back plate portion, whereby when the cover plate is connected with the back plate portion, the cover plate extends over a front surface of the back plate portion and serves to conceal the non-adhesive pull tab of the stretch releasing adhesive strip.

14. A shelf assembly as defined in claim 1, wherein the rear retaining wall portion comprises a base section adjacent to the shoulder portion and a tail section extending from the base section in a direction opposite to the shoulder portion, the base section and the tail section having a combined planar outer surface, and the base section having a material thickness greater than the tail section.

15. A shelf assembly as defined in claim 1, wherein the front retaining wall portion extends from a plane of the body portion at an angle when the assembly is secured to the wall.

* * * * *

UNITED STATES PATENT AND TRADEMARK OFFICE

CERTIFICATE OF CORRECTION

PATENT NO. : 8,596,473 B2
APPLICATION NO. : 11/849402
DATED : December 3, 2013
INVENTOR(S) : Newbould et al.

It is certified that error appears in the above-identified patent and that said Letters Patent is hereby corrected as shown below:

In the Specification

Column 3
Line 31, delete "abuse" and insert -- a base --, therefor.

Signed and Sealed this
Twelfth Day of August, 2014

Michelle K. Lee

Michelle K. Lee
*Deputy Director of the United States Patent and Trademark Office*